United States Patent [19]

Kuchenbecker

[11] Patent Number: 4,482,079

[45] Date of Patent: Nov. 13, 1984

[54] DISPOSABLE CUP DISPENSER

[75] Inventor: Morris W. Kuchenbecker, Neenah, Wis.

[73] Assignee: James River-Dixie/Northern, Inc., Norwalk, Conn.

[21] Appl. No.: 449,021

[22] Filed: Dec. 16, 1982

[51] Int. Cl.[3] ..... B65D 5/16

[52] U.S. Cl. ..... 221/310

[58] Field of Search ..... 221/303, 307, 310; 312/43; 206/217, 219, 499

[56] References Cited

U.S. PATENT DOCUMENTS 1,633,983 6/1927 Dawson et al. ..... 221/310 X

*Primary Examiner*—Stanley H. Tollberg

*Attorney, Agent, or Firm*—William A. Aguele; Harry W. Hargis, III; Thomas H. Whaley

[57] ABSTRACT

A dispenser package for holding a stack of nested tapered disposable cups and dispensing them individually. The dispenser package has a generally circular opening in the top wall through which the bottoms of the tapered cups protrude; surrounded by a series of arcuate dispensing jaws interconnected with straight sided segments forming yieldable segments around the periphery of the opening which permit the topmost protruding cup to be pulled through the opening, but which function to restrain the cups immediately below. Slits or knife cuts in the top wall of the dispenser package extend from the opening in the top wall to each of the sidewalls at the mid point of each sidewall to permit loading a stack of cups through the top opening of the dispenser package without tearing of the top wall.

7 Claims, 3 Drawing Figures

Fig. 1.
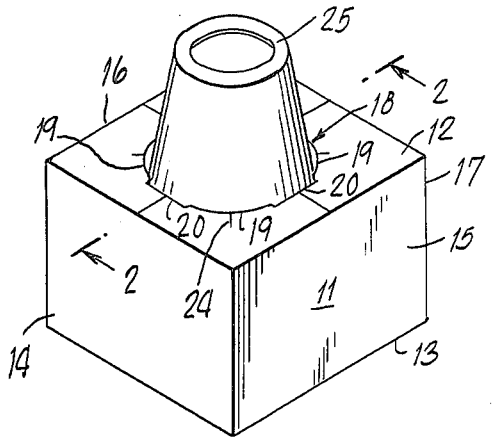
Fig. 2.
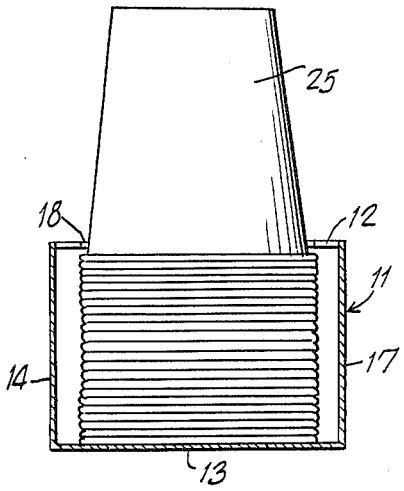
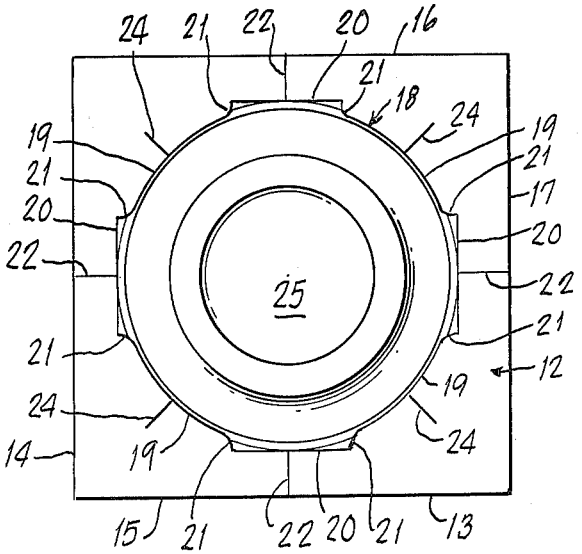
Fig. 3.

DISPOSABLE CUP DISPENSER

This invention relates to a dispenser package structure for holding and dispensing a stack of nested disposable cups.

Dispensers for paper and plastic disposable cups are well known in the art. Such dispensers usually are permanently or detachably mounted on a wall or other vertical surface. It is not always practicable to mount a wall dispenser in every desired location with the result that they frequently are mounted in a location not convenient to all users.

This invention provides an improved dispenser package structure for a stack of nested paper or plastic disposable cups that is suited as portable dispenser which may be used in a variety of positions and locations with or without mounting of the dispenser package on a wall or other surface.

In a commonly assigned copending patent application of Jerome Gould, et al, filed Jan. 12, 1982, an improved disposable paperboard package structure is disclosed which combines a cup package and dispenser, herein referred to as a dispenser package.

The dispenser package of this invention comprises a boxlike container or package having substantially planar, parallel, spaced walls wherein an end wall is provided with a generally circular opening through which cups may be individually dispensed. The dispenser package is adapted to hold a stack of nested paper or plastic cups of conventional shape, each cup having a tapered side wall, a circular bottom wall, a circular open top, and a rolled rim. The bottom wall of each cup is smaller in diameter than its top so that the cups may be nested or stacked within one another. The bottom of each cup is smaller than the opening in the wall of the dispenser package, hereinafter referred to as the top wall. The rolled rim surrounding the open end of the cup is of larger diameter than the opening in the top wall of the container so that when the container is loaded with a stack of cups, the cups protrude through the opening in the top wall of the container and rest on the other end wall, hereinafter referred to as the bottom wall. It will be understood that the dispenser may be used in any position and that the terms top wall and bottom wall are used herein for convenience of description and not by way of limitation. Cups may be removed or dispensed one at a time from the dispenser package by grasping a cup protruding through the opening in the top wall of the dispenser package and pulling it through the opening. A plurality of arcuate jaws surrounds the top opening of the dispenser package which may be flexed sufficiently to permit a cup to be withdrawn from the package while retaining the other cups in the stack within the dispenser package.

The dispenser package of the subject invention is so constructed and arranged a stack of cups to be loaded into the package through the top opening thereof without danger of impairing the ability of the dispenser package to dispense cups one at a time.

The present invention will be more fully understood from the following detailed description and the accompanying drawings, wherein FIG. 1 is a perspective view of a dispenser package of nested cups embodying this invention;

FIG. 2 is an elevational view partly in cross section showing of the dispenser package illustrated in FIG. 1, sectioned along the line 2—2;

FIG. 3 is a plan view of the package illustrated in FIG. 1;

and FIG. 4 is a bottom view of the package illustrated in FIG. 1.

With reference to FIG. 1 of the drawings, a dispenser package 11 is illustrated. The dispenser package 11 as illustrated is of a generally cubic configuration, including planar, parallel, spaced top and bottom walls 12 and 13, respectively, joined by planar side walls 14, 15, 16 and 17. Although illustrated as a foreshortened cube, the dispenser package may be of any desired length. A cube or a relatively short container having the top wall spaced from the bottom wall by less than the height of one cup is preferred and is particularly convenient to use as it may be used in any position. A particularly convenient position is illustrated in FIGS. 1 and 2 in which the cup stack is in a bottoms up position so that the container may be set on any convenient flat surface.

As illustrated in FIG. 3, the top wall 12 of the dispenser package is provided with a generally circular or generally octagonal opening 18. In a preferred embodiment illustrated in FIG. 3, the opening 18 is made up of four arcuate jaws 19, the arcuate segments each subtending an angle of 40° to 45° each interconnected to four straight sided segments 20 by curved fillets 21 having a small radius relative to the radius of the arcuate portion of jaws 19. The upper opening 18 as defined by the straight sided segments 20 and the circular segments of arcuate jaws 19 are smaller than the diameter of the top curl or rim of a cup. The purpose of the arcuate jaws 19 will become apparent from the following description of their function.

In use, an inverted stack of tapered cups 25 is disposed of dispenser package 11, as illustrated in FIG. 2 such that the tapered side wall and bottom wall of the end cup of a cup stack protrudes through opening 18, and the open top of the other end cup of the stack rests on the lower wall 13. Jaws 19 defining the smaller diameter portion of opening 18 are sufficiently flexible and resilient, as is the nature of the paperboard, to accommodate one-at-a-time removal of cups through opening 18.

The top wall 12 of the dispenser package is provided with slits or knife cuts 22 extending from the mid point of each of straight segments 20 defining opening 18 in the top wall 12 of the dispenser package to each of the sidewalls 14, 15, 16, and 17, at the mid point of each sidewall. The knife cuts are preferably positioned to extend from the center of the top of each side wall to the center of each straight segment 20 as illustrated in FIGS. 1 and 3. It has been found that provision of the knife cuts 22 permit a stack of cups 25 to be loaded into the package through the top opening 18 without tearing the top wall 12 of the package and without damage to arcuate dispensing jaws 19. The straight segments 20 are preferably parallel to the side walls and the arcuate jaws 19 are preferably opposite the corners of the top wall.

In a preferred embodiment of this invention, four diagonal slits or knife cuts 24 in the top wall 12 of the package intersect the opening 18 at the midpoint of the arcuate dispensing jaws 19. As a cup is dispensed, at times several cups may cling to one another whereupon the diagonal knife cuts 24 cause a slight division of dispensing jaws 19 on each side of slits 24 allowing the segments of the dispensing jaw to snap over the top rim or curl of the first cup onto the rim of the trailing cup thereby separating the cups and allowing a single cup to be dispensed. The combination of curved or arcuate jaws 19 and interconnecting straight sided segments 20 and radial slits 24 move with slight independence of one another to provide an improved cup dispensing package. The straight sided segments 20 contact only a very small area of the rim of a cup on either side of knife cuts 22. This arrangement serves to reduce resistance to withdrawal of a cup from the package. The combination of arcuate jaws 19, straight segments 20 and radial slits 22 and 24 cooperate to allow slight separations of the knife cuts with just enough movement for dispensing a single cup while retaining the remainder of the stack in the package.

While paperboard is the preferred material of the carton, it will be apparent that other materials affording adequate flexibility and resilience for flexure of the tabs, such as polyethylene or like plastic, or laminates including paperboard, plastic, or metal foil, will be suitable for use in achieving objectives and advantages of the invention.

I claim:

1. A dispenser carton for packaging and separately dispensing a cup from a stack of rimmed tapered disposable cups each of which has a tapered sidewall, a bottom wall, and an open top surrounded by a rolled rim, comprising a container carton having substantially square planar parallel mutually spaced top and bottom walls and connecting rectangular side walls; a generally circular opening in the top wall of said carton of a size sufficient to permit the bottom and tapered sidewall of a cup to extend freely therethrough and insufficient in size for passage of the rim of a cup freely therethrough; and a plurality of concave arcuate jaws defining a part of said opening and lying in the plane of said top wall while a cup is projecting through said opening and capable of being deflected in the direction of movement of a cup through said opening to permit passage of a cup therethrough by flexure of said jaws, each of said arcuate jaws subtending an angle of 40° to 45°.

2. A dispenser package as defined in claim 1 wherein said top wall is divided into a plurality of segments by knife cuts extending from the edge of said opening in said top to the mid point of each of said sidewalls with each segment having at least one arcuate jaw.

3. A dispenser package as defined in claim 1, wherein said flexible arcuate jaws are interconnected by straight sided segments parallel to the sidewalls forming an open area between said jaws larger than the diameter of the rim of a cup.

4. A dispenser package as defined in claim 1 wherein each jaw is provided with a radial knife cut at its mid portion extending outwardly from said opening.

5. A dispenser package as defined in claim 1 wherein said opening is defined by four arcuate jaws and four interconnecting straight sided segments joined to one another by curved fillets.

6. A dispenser package as defined in claim 1 wherein said top wall is spaced from said bottom wall by less than the height of one of said cups.

7. A dispenser package as defined in claim 3 wherein said top is divided into four equal segments by knife cuts extending from the mid point of each straight sided segment to the mid point of the sidewall nearest said straight sided segment.

* * * * *